US005174358A

United States Patent [19]

Bertin et al.

[11] Patent Number: 5,174,358

[45] Date of Patent: Dec. 29, 1992

[54] DEVICE FOR SUPPORTING AND REGULATING THE POSITION OF AN UPPER SPACER OF A MOULD FOR PRESSURE CASTING FLAT METAL PRODUCTS

[75] Inventors: Luc H. Bertin, Saint-Chamond; Michel F. Courbier, Le Breuil; Jean-Pierre L. Chalencon, Saint-Chamond, all of France

[73] Assignees: Creusot-Loire Industrie, Puteaux; Clecim, Cergy Pontoise, France

[21] Appl. No.: 720,864

[22] PCT Filed: Jan. 16, 1990

[86] PCT No.: PCT/FR90/00032

§ 371 Date: Sep. 10, 1991

§ 102(e) Date: Sep. 10, 1991

[87] PCT Pub. No.: WO90/07998

PCT Pub. Date: Jul. 26, 1990

[30] Foreign Application Priority Data

Jan. 16, 1989 [FR] France ..... 89 00455

[51] Int. Cl.[5] ..... B22D 17/20; B22D 17/22

[52] U.S. Cl. ..... 164/342; 164/306; 249/161

[58] Field of Search ..... 164/306, 309, 348, 339, 164/342, 119, 137; 249/161

[56] References Cited

U.S. PATENT DOCUMENTS

| | | | |
|---|---|---|---|
| 3,459,256 | 8/1969 | Jeffreys | 164/342 |
| 3,590,904 | 7/1971 | Woodburn, Jr. . | |
| 3,646,991 | 3/1972 | Jeffreys | 164/342 |
| 3,978,908 | 9/1976 | Klaus et al. . | |
| 4,669,524 | 6/1987 | Nelson | 164/348 X |

FOREIGN PATENT DOCUMENTS 3316951 11/1983 Fed. Rep. of Germany .

*Primary Examiner*—J. Reed Batten, Jr.

*Attorney, Agent, or Firm*—Cushman, Darby & Cushman

[57] ABSTRACT

This device (27) for suspending the upper spacer (20) is carried by a longitudinal beam (40) for clamping the walls (25) of the mould (5), each wall (25) consisting of a support frame (30) and a graphite block (31); the spacer (20) and the other spacers are clamped between the blocks (31) by the beams (40) actuated by the jacks (45), the slabs being cast between the blocks (31) and the four spacers; the device (27) comprises levers (51) which are mounted, so as to rotate, on the beam (40) and which carry screw jacks (61) connected by a bar (67) and which support the upper spacer (20); the angular position of the levers (51), controlled by a dual-action jack, determines the transverse position of the spacer (20) and the screw jacks (61), each provided with a double pivot, provide the spacer (20) with free pendular suspension. This mounting facilitates handling and maintenance operations of the mould, (5), particularly the removal of the supports (30) of the blocks (31).

8 Claims, 5 Drawing Sheets

27
69
68
61
72
67
60
5
51
62
52
25
30
40
20
57
59
58
33
31
45
25
37b
37
44
42
26
41
43
38b
6
7
8
21
55
45a
37a
38a

DEVICE FOR SUPPORTING AND REGULATING THE POSITION OF AN UPPER SPACER OF A MOULD FOR PRESSURE CASTING FLAT METAL PRODUCTS

The present invention relates to a device for supporting and regulating the position of an upper spacer of a mould for pressure casting flat metal products such as slabs.

This mould is carried by a frame and comprises two parallel lateral walls, each formed by a support equipped on the inside with graphite blocks, a longitudinal lower spacer inserted between the two graphite blocks at the base of the latter, a front spacer the lower end of which delimits, with the adjacent end of the lower spacer, an orifice for the molten metal to enter inside the mould between the graphite blocks of the lateral walls and spacers, a rear spacer inserted between the upper and lower spacers and which determines the width of the flat product.

The upper spacer is inserted between the graphite blocks along their upper edges. The lateral walls are associated with means for the transverse displacement of the latter and for clamping them against the spacers in order to form a cavity from which the molten metal cannot leak. To this end, the transverse walls are connected to rigid longitudinal beams parallel to the said walls, carried by the frame and which can be displaced transversely relative to the latter.

The molten metal may be introduced into the mould from a ladle disposed beneath the mould and its frame by means of a refractory tube, the lower part of which is immersed in the molten metal filling the ladle and the upper end of which communicates with a filling spout disposed at the lower part of the mould. As the refractory tube passes through a cover applied in a leaktight manner to a vessel containing the ladle of molten metal, the introduction of compressed air at a suitable pressure into the ladle makes it possible to cause the molten metal to rise inside the tube and into the mould which it progressively fills.

This pressure-casting method, which has been known for a long time, can be applied, in particular, to the casting of semi-manufactured products such as slabs, blooms, billets and tube rounds. In the case of slabs, that is to say of steel products of great width, large-dimension moulds are used.

A pressure-casting mould of the type to which the invention relates is described, in particular, in U.S. Pat. No. 3,590,904. The width of the spacers in the transverse direction determines the thickness of the flat product to be cast. The position of the upper spacer above the lower spacer determines the width of the slab cast in the mould. This upper spacer comprises, at its front end, an end part bent at a right angle, that is to say which is located in the part of the mould placed above the filling tube of the casting vessel.

The upper spacer is held by suitable suspension devices at a certain height above the lower spacer and parallel thereto. It must be possible for it to be regulated in terms of height, as a function of the desired width for the slab to be cast. In the transverse direction, it must be possible for it to be positioned appropriately as a function of the progressive wear of the opposite faces of the graphite blocks between which it is clamped, during successive casts. Finally, this upper spacer must be capable of being completely retracted in order to permit removal of the support frames for the worn graphite blocks.

It is thus known to use devices for suspending the upper spacer which are carried by one of the above-mentioned supports forming a graphite-holder frame. These support frames consist, for example, of pieces with a C-shaped transverse section, inside which the graphite blocks are partially engaged.

This mounting of the suspension devices involves several complications, in particular in relation to the handling of the supports of the graphite blocks when it is necessary to remove the latter or to place the graphite blocks in their position for brushing and coating their inner face, in order to repair them before fresh casts. Moreover, it is observed that, with these known suspension devices, placing the spacer in the casting position for the various thicknesses of slabs involves regulating difficulties. Moreover, it is necessary to perform an entire series of regulations of the position of the upper spacer in the horizontal direction in step with the progressive wear of the opposite faces of the graphite blocks in order to enable it to be pressed against these faces at the time of each cast.

The aim of the invention is thus to propose a device which permits elimination of the various drawbacks and difficulties.

According to the invention, the device for supporting and regulating the upper spacer is mounted on one of the longitudinal beams and comprises means providing free pendular suspension of the spacer in the horizontal direction.

Mounting of the device on a longitudinal beam completely frees the graphite-holder frames by preventing them being encumbered by the device for supporting the spacer when these frames have to be removed and when it is necessary to perform brushing and coating operations on the inner faces of the graphite blocks.

Moreover, the free pendular suspension of the upper spacer in the horizontal direction enables it to be pressed freely, without stress, on the faces of the graphite, the lateral walls of the mould being pressed transversely against the spacers by suitable elastic and hydraulic devices.

According to one embodiment of the invention, the suspension means comprise levers distributed along the beam and mounted on the latter so as to rotate about substantially vertical shafts, and screw jacks carried by the ends of the levers and the screws of which, supporting the upper spacer, are mounted in complementary pivots which permit a free horizontal displacement of the spacer, the jacks also being disposed in a substantially vertical direction so that it is possible to raise or lower the spacer.

Each screw jack is thus equipped with a first pivot, through which the screw passes and which permits the latter and the upper spacer a slight free angular clearance in all directions, and with a second articulation pivot between the end of the screw and a piece attached to the spacer.

Among other advantages, this device for regulating and supporting the upper spacer makes it possible completely to retract the latter when the graphite-holder frame corresponding to the beam supporting the regulating device has to be removed. This operation can thus be performed without being hindered by the encumbrance of the device for supporting the spacer.

Other features and advantages of the invention will become apparent during the following description which is made with reference to the appended drawings which illustrate, by way of example, a non-limiting embodiment thereof.

Figure 1:
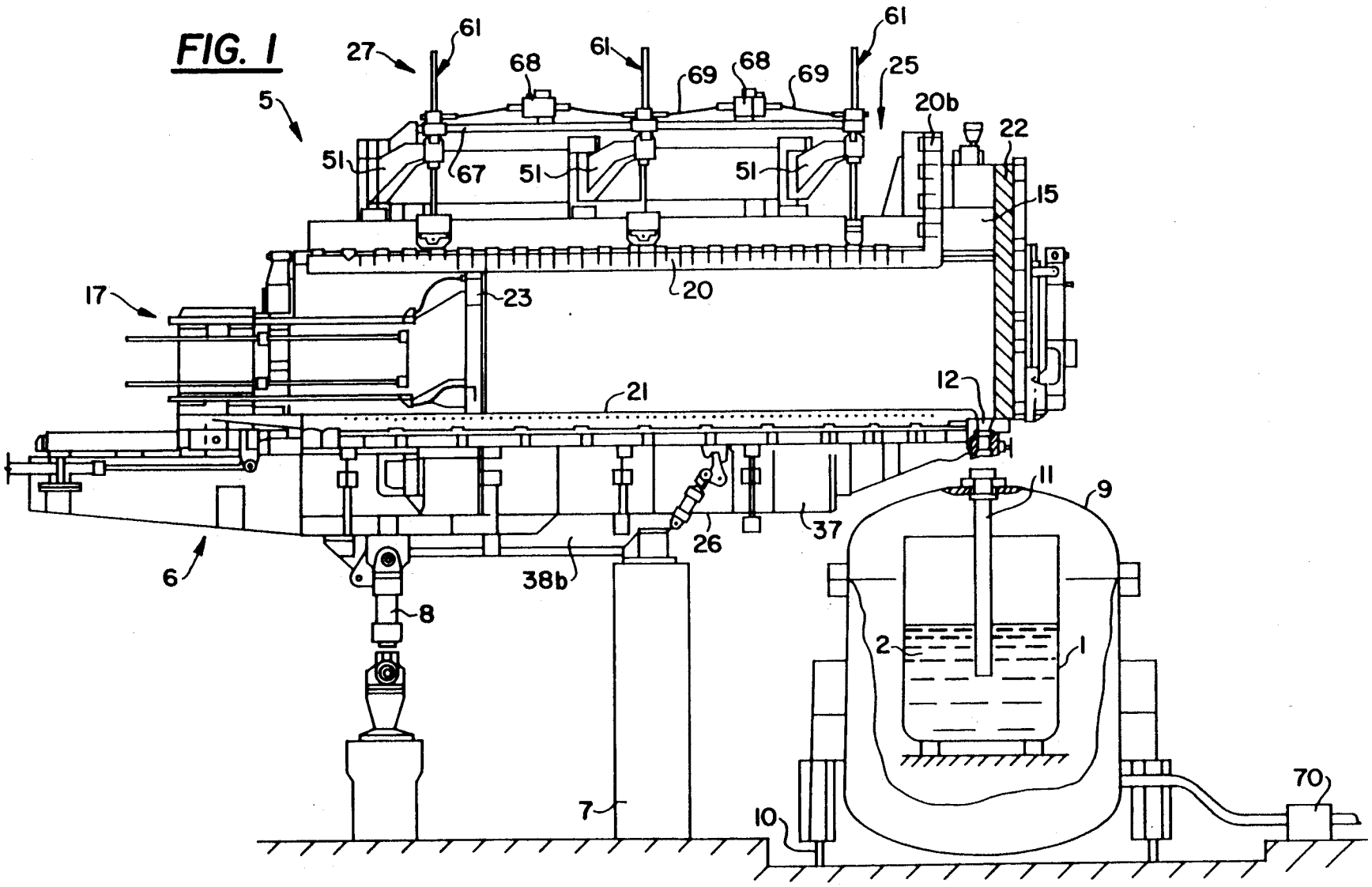
FIG. 1 is a view in longitudinal section according to a vertical median plane and in partial elevation of the mould for pressure casting flat metal products, equipped with a device for supporting and regulating the upper spacer according to the invention.

The installation for pressure casting flat metal products to which the invention relates comprises (FIG. 1) a ladle 1 of molten metal 2 disposed in a vessel 4 supported by a carriage 10, and a mould 5 resting on a frame 6 which is itself supported by columns 7 and a hydraulic jack 8.

The vessel 4 is equipped with a leaktight cover 9 through which passes a refractory tube 11, the lower end of which is immersed in the molten metal 2 and the upper end of which passes through the cover 9 at the level of a device which is known per se and which makes it possible to provide a leaktight join between an opening 12 for filling the mould 5 and the tube 11. An apparatus 70 makes it possible to convey, inside the ladle 1, compressed air at a suitable pressure which forces the molten metal 2 into the tube 11 in order to cause it to penetrate inside the mould 5 in order to cast a flat metal product such as a slab.

In FIG. 1, the assembly formed by the mould 5 and its support frame 6 is shown horizontally. The jack 8 makes it possible to tilt the frame 6 and the mould 5 about a horizontal shaft 30 transverse to the plane of the figure, in order to slightly incline the mould 5 in order to bring it into its position permitting the casting of the molten metal 2, in a manner known per se.

The mould 5 comprises two parallel lateral walls 25 each consisting of a support 30 and of a graphite block 31 partially housed in the support 30 which, in the example shown, has, in cross-section, a C shape, the upper and lower branches of which together partially surround the block 31. The mould 5 also comprises, disposed between the inner opposite faces 32 of the two blocks 31, a longitudinal lower spacer 21 placed at the base of the blocks 31, a front spacer 22 which extends vertically when the mould 5 is placed in a horizontal position (FIG. 1) and is positioned such that its lower end delimits, with the adjacent end of the lower spacer 21, the orifice 12 for the molten metal to enter inside the mould 5 between the graphite blocks 31.

A rear spacer 23 is inserted between the lower spacer 21 and an upper spacer 20. The rear spacer 23 determines the width of the flat product to be cast and can be displaced in a sliding manner between the spacers 20 and 21 by means of a device 17, in order to regulate the length of the flat product to be cast, this device 17 being carried by the frame 6. The upper spacer 20 is disposed opposite the upper part of the blocks 31 at a height above the lower space 21 which determines the width of the product to be cast. The upper spacer 20 comprises, opposite the upper end of the front spacer 22, an end part **20*b* bent upwards at a right angle, which, with the upper end of the spacer 22, delimits a riser 15 in which the cast metal can penetrate at the end of filling the mould 5. This channel 15 places the inner volume of the mould 5** in communication with the shell, not shown, which is filled at the end of the cast by a header of molten metal which can give rise to a shrinkage hole after solidification of the slab.

The lower spacer 21 is supported by the frame 6 and disposed in the longitudinal direction of the slab to be cast. The spacers 20, 21, 22, 23 all have the same thickness, which corresponds to the thickness of the flat product cast.

Figure 2:
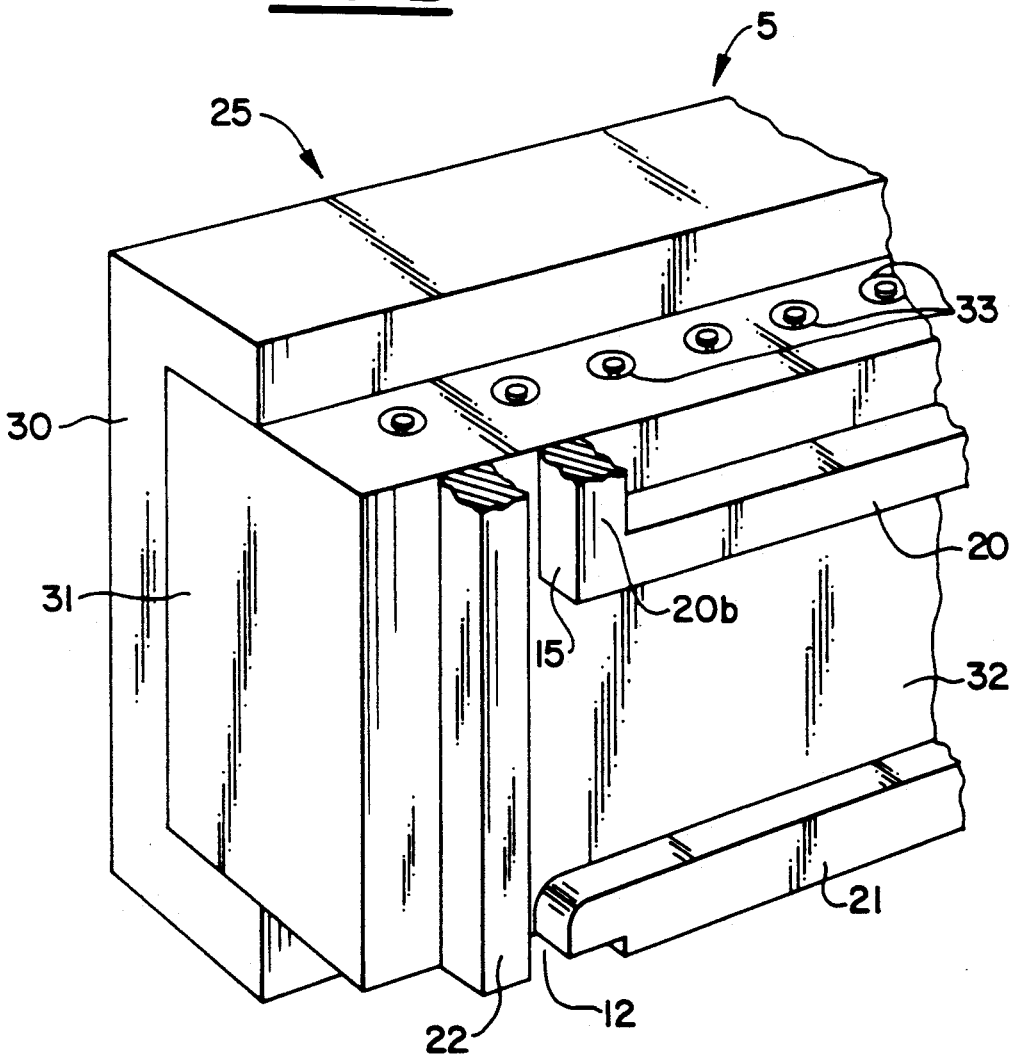
FIG. 2 is a view in partial perspective of the mould in FIG. 1.

The graphite blocks 31 of the walls 25 are pierced with channels 33, (FIG. 2) which makes it possible to receive devices for cooling the blocks 31 by spraying water.

Figures 3A, 3B:
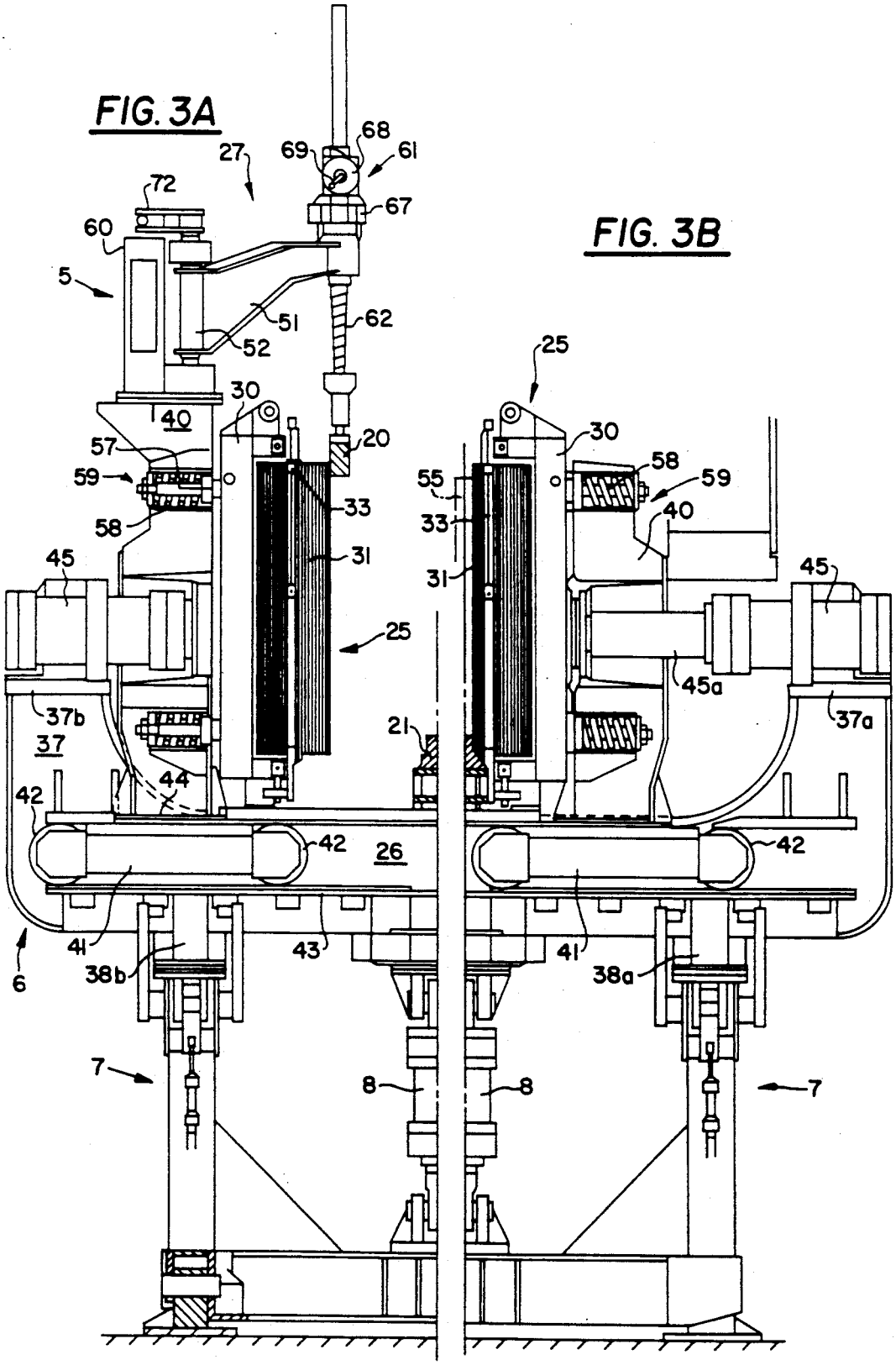
FIGS. 3A and 3B are complementary half-views in elevation of the mould in FIG. 1 and of its support frame; the lateral wall of the mould is shown spaced from the longitudinal median plane of the mould in FIG. 3A, as well as the device for suspending the upper spacer, whereas, in FIG. 3B, the second lateral wall is shown in the casting position, with a heavily worn graphite block.

The frame 6 comprises (FIGS. 1 and 3A–3B) a central longitudinal member 26 on the upper surface of which the lower spacer 21 bears, as well as two transverse elements 36 and 37 in the shape of a C or a U. The ends of these two elements 36 and 37, facing upwards, among which only the ends **37*a*, 37*b* of the element 37 are visible in FIGS. 3A and 3B, form supports for the means for displacement and clamping of the lateral walls 25. These bearing ends are connected, at their lower part, by bearing longitudinal members 38*a*, 38*b* parallel to the longitudinal member 26 and which make it possible to improve the rigidity of the frame 6. The longitudinal members 38*a*, 38*b* also provide bearing surfaces which improve the stability of the mould 5 resting in the casting position on the bearing columns 7 located laterally at the level of the longitudinal members 38*a*, 38*b***.

The lateral walls 25 are associated with means for the transverse displacement thereof and clamping against the spacers 20 to 23 in order to form a cavity from which molten metal cannot leak between the latter and the blocks 31. To this end, the walls 25 are connected to rigid longitudinal beams 40 extending substantially over the entire length of the mould 5 parallel to the walls 25 and which are each supported by a carriage 41 provided with rollers 42 for travelling on transverse tracks provided on a bearing rail 43 carried by the frame 6 and on an upper plate 44 fixed to the rectilinear part of the transverse elements 36, 37. The means for displacing and clamping the walls 25 comprise four hydraulic jacks 45 each mounted on a bearing end such as **37*a*, 37*b* of the elements 36, 37 forming fixing plates of the bodies of the jacks 45. The rods 45*a* of the latter are connected to the corresponding beam 40 at the level of the structure element 36, 37, and the forces exerted by the jacks 45 are transmitted to the walls 25 by elastic joining devices 59 placed transversely in the beams 40 above and below the jacks 45. Each joining device 59 comprises, for example, a rod 57 passing through a bore in the beam 40 and attached at its ends to, on the one hand, the beam 40 and to the associated support 30, as well as a helical spring 58 disposed coaxially with each rod 57** and bearing via its ends on the bottoms of the housing of the latter.

The upper ends of the transverse elements 36 and 37 are connected by torsion bars (not visible in the figures) parallel to the beams 40 and the walls 25, assemblies of articulated connecting rods connecting the torsion bars to each associated beam 40.

The assembly of the devices mentioned hereinabove and their operation are described in detail in a patent application No. 07/720,778 filed by the Applicants on the same day as the present application and entitled "Mould for casting flat metal products such as slabs". This description does not form part of the present invention so will not be referred to in detail here, only those elements of the installation necessary for the understanding of the invention being described in the present application.

The pressure-casting installation shown in the drawings also comprises a device 27 for supporting and regulating the position of the upper spacer 20, which will now be described.

Figure 4:
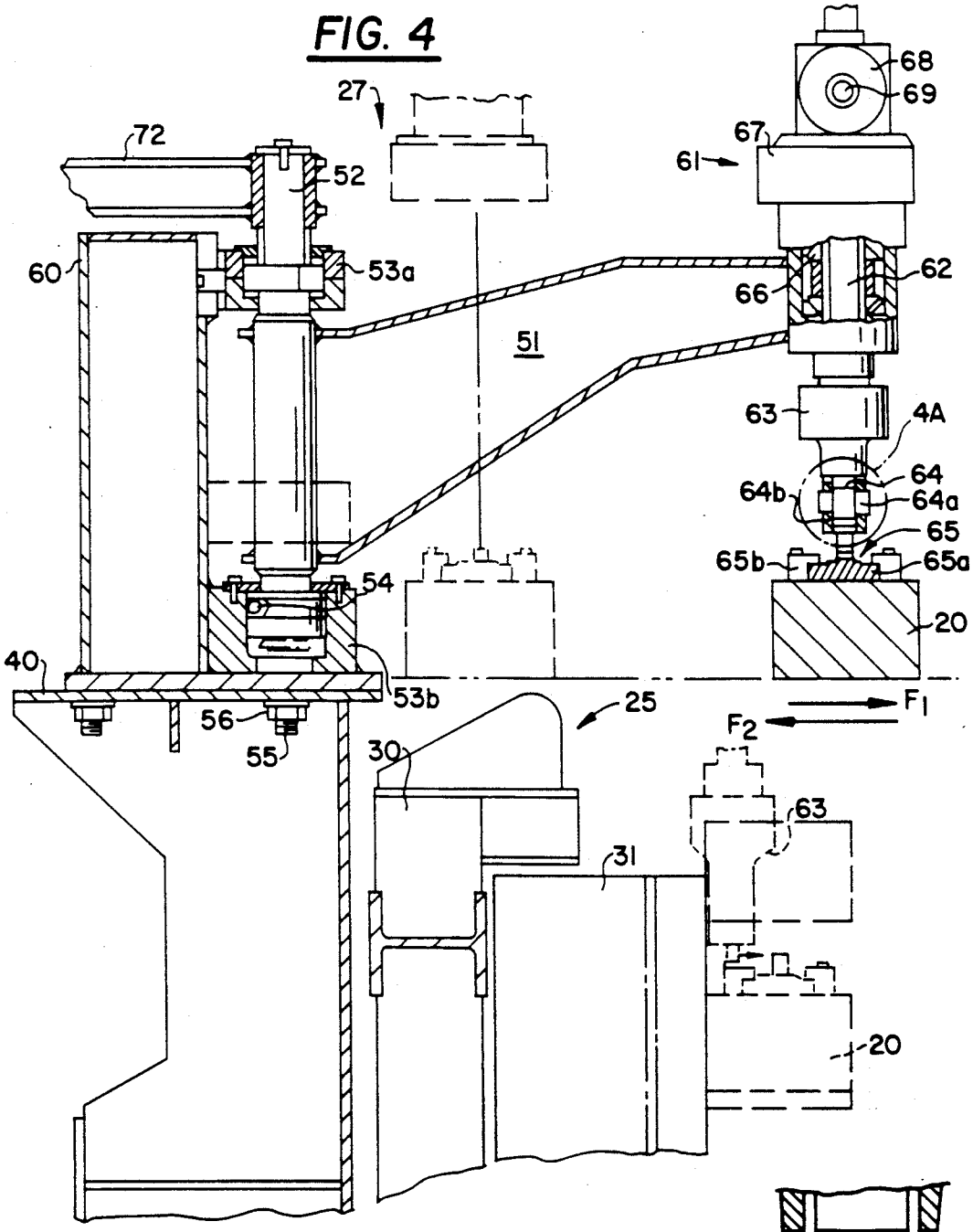
FIG. 4 is a view in elevation and partial section of one of the elements forming the device for supporting and regulating the upper spacer, shown in a simplified manner in FIGS. 1 and 3A.

The device 27 is mounted on one of the beams 40 and comprises means providing free pendular suspension of the spacer 20 in the horizontal direction, in particular in the transverse direction of the mould 5 (arrows F1 and F2 in FIG. 4). In the example described, these means comprise levers 51 distributed along the beam 40 and mounted thereon so as to rotate about substantially vertical shafts 52. In this example, the levers 51 are three in number and are disposed at uniform intervals along the beam 40. Each shaft 52 is mounted so as to rotate in rolling bearings 53*a*, 53*b*, advantageously equipped with rollers 54 (FIG. 4). The lower bearing 53*b* is fixed on the frame 60 by any appropriate means. The upper bearing 53*a* is itself fixed in a removable manner on the frame 60 carried by the beam 40, to which it is fixed by screws 55 and nuts 56.

Figure 4A:
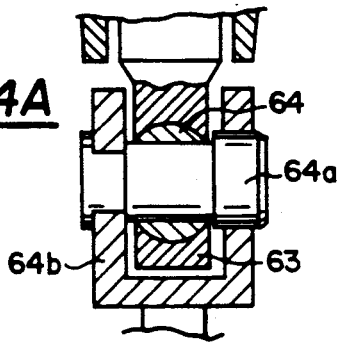
FIG. 4A is a view in partial section on a larger scale of a detail of FIG. 4.

The end of each lever 51 opposite the shaft 52 carries a jack 61 with a screw 62 which supports the lower spacer 20. The join between the lower end of the screw 62 and the spacer 20 is provided by a rotating piece 63 receiving the said end and a pivot 64 through which passes a shaft 64*a* (FIG. 4 and 4A). The pivot 64 is mounted in corresponding bearing surfaces in the lower end of the piece 63.

A stirrup piece 64*b* attached to an elongated piece 65*a* of a device 65 comprising lugs 65*b* for holding the piece 65*a*, is suspended from the shaft 64*a*, said lugs being fixed to the spacer 20 by bolts.

Thus, the assembly of the spacer 20 of the device 65, of the stirrup piece 64*b* and the shaft 64*a* can oscillate with the pivot 64, the two arms of the stirrup piece 64*b* being, to this end, slightly distant from the end of the piece 63.

Each screw 62 is also mounted in a spherical pivot 66 housed inside the body of the jack 61 and which permits the screw 62 a slight angular clearance in all directions. Each pivot 66 complements the pivot 64 in order to provide therewith free pendular suspension of the spacer 20, enabling the latter, within certain limits, free horizontal displacement once its height has been determined by the position of the screw 62.

The jacks 61 are disposed in a substantially vertical direction so that they can raise or lower the spacer 20. These jacks 61 are connected by a horizontal bar 67 on which are placed motors 68 controlling the jacks 61 by means of transmissions 69 articulated, on the one hand, on the motors 68 and, on the other hand, on the bodies of the jacks 61.

The suspension device 27 is also equipped with means for controlling the angular position of the levers 51 in order to regulate the transverse position of the spacer 20 between the graphite blocks 31. In the example shown, these means comprise a dual-action jack 71 disposed on the frame 60 between two shafts 52 (FIG. 5), the opposite ends of which are articulated on connecting rods 72, 73 respectively, attached in rotation to the corresponding shafts 52. Thus, the jack 71 forms, with the two associated levers 51 and the bar 67, a parallelogram which is articulated, on the one hand, on the shafts 52 attached to the levers 51, and, on the other hand, to the connections of the levers 51 with the jacks 61. Control of the jack 71 thus permits angular displacement of the assembly of the three levers 51 and the screw jacks 61 in order to transversely displace the spacer 20.

Figure 6:
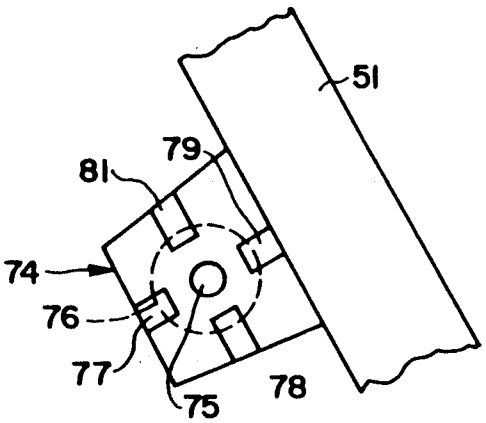
FIG. 6 is a top view of an angular positioning stop of the levers of the device for supporting the upper spacer, this stop also being shown in a simplified manner in FIG. 5.

Finally, the device 27 is provided with a stop 74 for holding the levers 51 in their angular position controlled by the jack 71 and, consequently, for holding the spacer 20 in its corresponding transverse position between the blocks 31, as a function of the dimensions of the latter and of the format of the product to be cast. The stop 74 interacts with the central lever 51 and comprises a block (FIG. 6) with several faces, for example four faces with different inclinations. The block 74 is mounted in a removable manner on the frame 60 so as to rotate about a shaft 75 carried by the latter. A blind hole is provided in the frame 60, for receiving a peg 76 which can be introduced as a function of the face of the block 74 which has been chosen in order to act as a bearing for the lever 51 in one of four corresponding notches 77, 78, 79 and 81 which are made in the respective faces of the block 74.

When it is desired for the stop 74 to hold the corresponding lever 51 and the other levers 51 in a specific angular position, the block 74 is removed from the shaft 75 and is then repositioned on this shaft with the chosen angular orientation and the peg 76 is introduced into the notch in the opposite face to the lever 51 in order to lock the stop 74 in rotation and to hold the upper spacer 20 in the chosen transverse position.

Implementation of the device 27 for suspending and regulating the spacer 20 results directly from the above description. At the start of the cast, the lateral walls 25 are brought closer to one another so that the blocks 31 surround, via their inner faces 32, the spacers 20 to 23, the upper spacer 20 having, in terms of height, the position shown in FIG. 3A. This figure shows the cross-section of the slab 55 which extends, in terms of height, between the upper spacer 20 and the lower spacer 21. After suitable positioning of the stop 74, the spacer 20 is brought into the desired transverse position above the blocks 31 by means of the dual-action jack 71 and the levers 51 and is then lowered between the latter by the screw jacks 61 controlled by the motors 68 as far as the height above the lower spacer 21 which corresponds to the width of the flat product to be cast.

Figure 5:
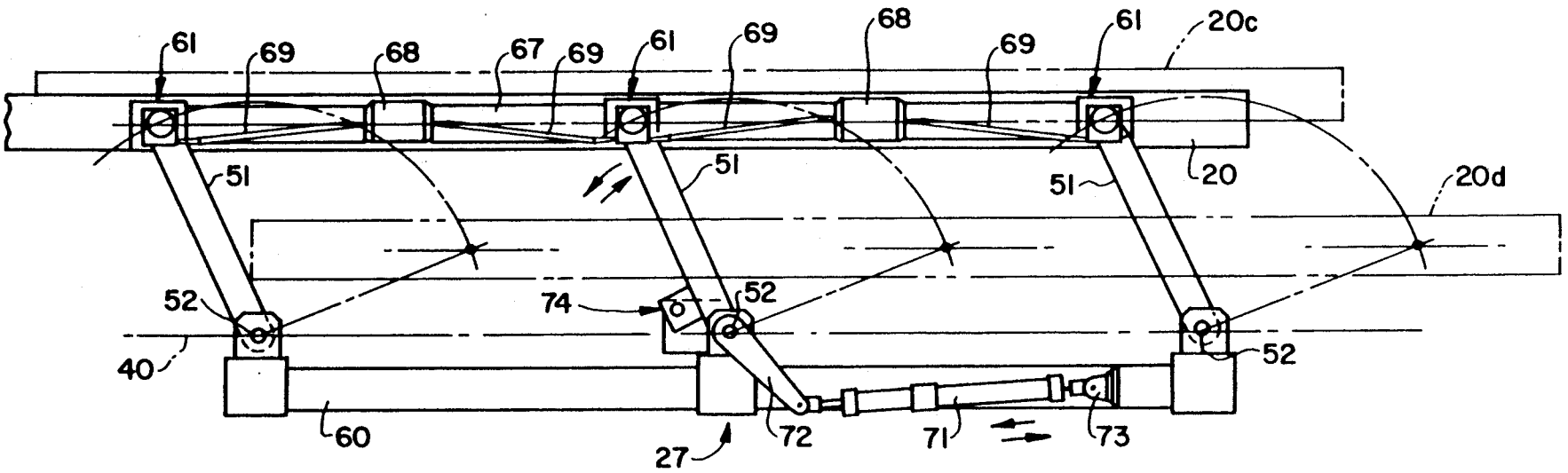
FIG. 5 is a plan top view of the device for regulating and supporting the upper spacer.

Once the spacer 20 has been positioned, the stop 74 holds the articulated assembly consisting of the levers 51 and the bar 67 in position. FIG. 5 shows, in dot-dash lines, two possible positions 20*c* and 20*d* of the spacer 20 connected with the corresponding angular positions of the levers 51.

The mounting of the suspension device 27 on a longitudinal beam 40 for clamping the mould 5, its articulated parallelogram structure controlled by the dual-action jack 71 and the complementary pivots 64 and 66 of each screw jack 61 permit the necessary displacements of the upper spacer 20 such that, under all circumstances, the following are possible:

retraction of the spacer 20, that is to say its placing in a non-operational position beyond the supports 30 by pivoting the levers 51 about their shafts 52, on command from the jack 71, in order to permit the removal of the support frames 30 without being hindered by the encumbrance of the suspension device 27.

the placing of the blocks 31 in a position for brushing-/coating after each slab casting, the placing in the casting position of the spacer 20 for the various thicknesses of slabs simply by regulating the stop 74 so that the latter presents the lever 51 with the bearing face corresponding to the transverse position desired for the spacer 20 and, control of the jack 71.

Moreover, by virtue of the free pendular suspension of the upper spacer 20, the latter can be freely pressed without stress on the faces 32 of the graphite blocks 31. The pendular mounting thus makes the spacer 20 free horizontally and results in the following:

on the one hand, offsetting of the movement due to the compression of the springs 58 of the elastic devices 59 upon closure of the mould 5 by "swinging" the spacer 20 over the two sets of pivots 64, 66. This free movement permits effective clamping of the spacer 20 between the free faces 32 of the blocks 31 without putting stress on the mechanism.

on the other hand, the fact that a movement to regulate the suspension device 27 overall makes it possible to regulate the position of the spacer 20 as a function of the wear of the faces 32 of the blocks 31, this adjustment being periodic in this pressure-casting method.

The invention is not limited to the embodiment described and may comprise several alternative embodiments. Thus, the number of levers 51 may vary as a function of the length of the walls 25 and any other equivalent stop system could replace the stop 74. Similarly, the jacks 61 and 71 may be replaced by any equivalent means providing transverse regulation and free pendular suspension of the upper spacer 20.

We claim:

1. Device for supporting and regulating the position of an upper spacer of a mould for pressure casting a flat metal product, carried by a frame, said mould including two parallel lateral walls, each formed by a support equipped on the inside with a graphite block, a longitudinal lower spacer inserted between the graphite blocks at the base of the latter, a front spacer, the lower end of which delimits, with the adjacent end of the lower spacer, an orifice for molten metal to enter inside the mould between the graphite blocks of the lateral walls and the spacers, a rear spacer inserted between the upper and lower spacers and having a height corresponding to the width of the flat product, the upper spacer being inserted between the graphite blocks along their upper edges, the lateral walls being associated with means for the transverse displacement of the lateral walls and for clamping them against the spacers in order to form a cavity from which molten metal cannot leak, and the lateral walls also being connected to rigid longitudinal beams parallel to the said lateral walls, carried by the frame and displaceable transversely relative to the latter by the said means, said device comprising means supporting said upper spacer and for providing free pendular suspension of the upper spacer in the horizontal direction, said device being mounted on one of the longitudinal beams.

2. Device according to claim 1, characterized in that the said supporting means comprise levers distributed along the beam and mounted on the latter so as to rotate about substantially vertical shafts, and jacks carried by the ends of the levers and which support the upper spacer, in which are mounted complementary pivots which permit a free horizontal displacement of the spacer, the jacks also being disposed in a substantially vertical direction so that it is possible to raise or lower the spacer.

3. Device according to claim 2, characterized in that, at their ends opposite the jacks, the shafts of rotation of the levers are mounted so as to rotate in rolling bearings fixed to a frame attached to the longitudinal beam.

4. Device according to one of claims 2 and 3, including means for controlling the jacks including motors supported by a bar for joining the jacks to which they are connected by means of articulated transmissions.

5. Device according to claim 4, including means for controlling the angular position of the levers in order to regulate the transverse position of the spacer between the graphite blocks, including a dual-action jack carried by the longitudinal beam, articulated at its ends on connecting rods attached in rotation to the shafts of two levers, the dual-action jack forming, with the latter and the joining bar between them, a parallelogram which is articulated, on the one hand, on the shafts attached to the levers and, on the other hand, to the joins of the levers and of the jacks carrying the spacer, control of the dual-action jack making it possible to angularly displace the assembly of the levers and of the jacks in order to transversely displace the upper spacer.

6. Device according to claim 5, including stop means which can vary the angular position of the levers.

7. Device according to claim 6, characterized in that one of the levers is associated with a regulating stop comprising a block with several faces of different inclinations, mounted in a removable manner on the frame carried by the beam so that the associated lever can come to bear on one of the faces with a specific corresponding angular orientation transmitted to the other levers via the articulated parallelogram, means being provided so that this block can be fixed in rotation in a chosen orientation.

8. Device according to claim 7, characterized in that the means for fixing the block in the chosen angular position comprise a peg which can be introduced into one of several lateral notches in the block and be embedded in the frame, each notch being provided in a corresponding face of the block which has a specific inclination.

* * * * *